US007833052B2

(12) United States Patent
Sugiura et al.

(10) Patent No.: US 7,833,052 B2
(45) Date of Patent: Nov. 16, 2010

(54) CONNECTOR FOR COAXIAL CABLE

(75) Inventors: Toshihiro Sugiura, Aichi (JP); Tsuneyuki Inayoshi, Aichi (JP); Chikahiko Nakane, Aichi (JP); Shigemitsu Toriyama, Aichi (JP); Yoshiro Hoshino, Aichi (JP); Masahiro Otsu, Aichi (JP)

(73) Assignee: Masprodenkoh Kabushikikaisha (JP)

( * ) Notice: Subject to any disclaimer, the term of this patent is extended or adjusted under 35 U.S.C. 154(b) by 0 days.

(21) Appl. No.: 12/295,353

(22) PCT Filed: Oct. 31, 2006

(86) PCT No.: PCT/JP2006/321782

§ 371 (c)(1),
(2), (4) Date: Sep. 30, 2008

(87) PCT Pub. No.: WO2007/116553

PCT Pub. Date: Oct. 18, 2007

(65) Prior Publication Data

US 2009/0117780 A1 May 7, 2009

(30) Foreign Application Priority Data

Mar. 31, 2006 (JP) ..... 2006-100269
Jun. 14, 2006 (JP) ..... 2006-164944

(51) Int. Cl.
*H01R 9/05* (2006.01)

(52) U.S. Cl. ..... 439/578; 439/584

(58) Field of Classification Search ..... 439/578–585
See application file for complete search history.

(56) References Cited

U.S. PATENT DOCUMENTS 4,990,106 A 2/1991 Szegda (Continued)

FOREIGN PATENT DOCUMENTS

JP 55 80886 6/1980

(Continued)

OTHER PUBLICATIONS

Form PCT/IB/338 from corresponding PCT application No. PCT/JP2006/321782, 1 page (dated Oct. 30, 2008).

(Continued)

*Primary Examiner*—Thanh-Tam T Le
(74) *Attorney, Agent, or Firm*—Westman, Champlin & Kelly

(57) ABSTRACT

A connector for a coaxial cable has a connector body and a securing ring. The connector body includes a tubular insertion section that is insertable between an insulation member around a core conductor of the coaxial cable and a woven conductor around the insulation member, a flange section that is provided around the insertion section and with which both the woven conductor of the coaxial cable and a cover member around the woven conductor come into contact when the insertion section is inserted in the coaxial cable to position the insertion section, and an annular fitting section that is provided at the insertion section, on the opposite side of the coaxial cable, and into which an object to be connected is insertable. The securing ring is used to pressure-bond and fix the coaxial cable to the insertion section from the periphery of the coaxial cable after the insertion section of the connector body is inserted in the coaxial cable. The connector has a fixation section for fixing the connector body and the securing ring together.

4 Claims, 12 Drawing Sheets

U.S. PATENT DOCUMENTS

| | | | | |
|---|---|---|---|---|
| 5,632,651 | A * | 5/1997 | Szegda | 439/578 |
| 6,425,782 | B1 * | 7/2002 | Holland | 439/585 |
| 6,905,365 | B1 * | 6/2005 | Liu | 439/578 |
| 7,192,308 | B2 * | 3/2007 | Rodrigues et al. | 439/578 |
| 7,288,002 | B2 * | 10/2007 | Rodrigues et al. | 439/578 |

FOREIGN PATENT DOCUMENTS

| | | |
|---|---|---|
| JP | 59-26545 | 8/1984 |
| JP | 61-149422 | 9/1986 |
| JP | 3-5109 | 2/1991 |
| JP | 3-102787 | 4/1991 |
| JP | H6-068342 | 9/1994 |
| JP | 11-8021 | 1/1999 |
| JP | 11167963 | 6/1999 |
| JP | 2005-108566 | 4/2005 |

OTHER PUBLICATIONS

Form PCT/IB/373 from corresponding PCT application No. PCT/JP2006/321782, 1 page and translation of Form PCT/ISA/237 (Written Opinion of the International Searching Authority) from corresponding PCT application No. PCT/JP2006/321782, 4 pages (dated Oct. 21, 2008).

Japan Patent Office, Decision of Rejection and translation from corresponding Japanese application No. 2006-164944, dated Nov. 9, 2007, 3 pages.

Japan Patent Office, Notice of Reason(s) For Rejection and translation from corresponding Japanese application No. 2006-164944, dated Dec. 4, 2006, 5 pages.

"Notice of Reason(s) For Rejection" from corresponding Japanese application No. 2005-175127 issued Oct. 20, 2009 (and partial translation thereof into English), 3 pages.

"Notice of Reason(s) For Rejection" from corresponding Japanese application No. 2007-277742 issued Oct. 20, 2009 (and partial translation thereof into English), 3 pages.

International Search Report from priority PCT Application PCT/JP2006/321782 (2 pages, listing cite Nos. 1-5 above).

Chinese language Office Action from corresponding Chinese application No. 200680054071.3, issued Apr. 28, 2010, 4 pages.

English translation of Chinese Office Action from corresponding Chinese application No. 200680054071.3, issued Apr. 28, 2010, 6 pages.

* cited by examiner

CONNECTOR FOR COAXIAL CABLE

CROSS-REFERENCE TO RELATED APPLICATION

This Application is a Section 371 National Stage Application of International Application No. PCT/JP2006/321782, filed Oct. 31, 2006, and published as WO 2007/116553 A1 on Oct. 18, 2007, not in English.

TECHNICAL FIELD

The present invention relates to a coaxial cable connector to be attached to an end section of a coaxial cable and connect the coaxial cable with an object to be connected such as an F-type relay, an F-type antenna terminal and so on.

BACKGROUND ART

Conventionally, this type of coaxial cable connector is known to have a connector body 10 and a securing ring 20. As shown in FIG. 15(*a*), the connector body 10 has a tubular insertion section 12 that is insertable between an insulation member 6 around a core wire 4 of a coaxial cable 2 and a woven conductor 8 around the insulation member 6, a flange section 14 that is provided around the insertion section 12 to position the coaxial cable, a fitting section 16 that is rotatably provided at the insertion section 12, on the opposite side of the coaxial cable, and into which an object to be connected, such as an F-type relay, an F-type antenna terminal and so on, can be screwed. The securing ring 20 is used to pressure-bond and fix the coaxial cable 2 to the insertion section 12 of the connector body 10 from an outer periphery of the coaxial cable 2, after the insertion section 12 of the connector body 10 is inserted to an inner periphery of the woven conductor 8 of the coaxial cable 2 (see Unexamined Japanese Patent Publication No. 11-167963, Unexamined Japanese Patent Publication No. 2005-108566 and so on, for example).

When attaching this type of coaxial cable connector to the coaxial cable 2, a tip end of the coaxial cable 2 is processed as follows. Firstly, a cover member 9 around the woven conductor 8 is removed by a predetermined length of La from the tip end of the coaxial cable 2. The woven conductor 8 is then folded back rearward along an edge of the cover member 9. Thereafter, the insulation member 6 inside the woven conductor 8 is cut off to protrude on the tip end side by a predetermined length of Lb. As a result, the core wire 4 is exposed by a predetermined length of Lc.

After the processing of the coaxial cable 2, the coaxial cable connector is fixed to the coaxial cable 2, as shown in FIG. 15(*b*). That is, after the securing ring 20 is fitted to the coaxial cable 2, the connector body 10 is inserted from the tip end side of the coaxial cable 2 such that the insulation member 6 is passed into the insertion section 12. Thereafter, as shown in FIG. 15(*c*), the securing ring 20 is moved toward the tip end side of the coaxial cable 2 to be arranged around the insertion section 12. A pair of pressure-bonding projections 22, 24 provided in a protruding manner on the securing ring 20 are then pressure-bonded with a pair of pliers or the like (see FIGS. 15(*d*) and (*e*)).

DISCLOSURE OF THE INVENTION

Problems to be Solved by the Invention

The reason why the woven conductor 8 is folded back from the edge side of the cover member 9 when attaching the coaxial cable connector to the coaxial cable 2 as above, is to facilitate insertion of the insertion section 12 of the connector body 10 to between the insulation member of the coaxial cable 2 and the woven conductor 8, and to ensure connection of the woven conductor 8 to the insertion section 12 (and to the connector body 10). However, if the woven conductor 8 is folded back as above, the woven conductor 8 has to be fitted inside the securing ring 20, as shown in FIG. 15(*c*), when pressure-bonding and fixing the coaxial cable 2 with the securing ring 20. There is a problem that the pressure-bonding operation is bothersome.

That is, the woven conductor 8 comes loose at the time of fold-back operation. The tip end of the woven conductor 8 spreads out around the coaxial cable. Thus, it is difficult to fit the woven conductor inside the securing ring 20 at the time of the pressure-bonding operation. The pressure-bonding operation becomes tiresome.

The reason why the woven conductor has to be fitted inside the securing ring 20 at the time of the pressure-bonding operation is because not only the appearance is unattractive but the woven conductor may contact other wiring or electric component thereby to cause defects, if the woven conductor is not fitted inside the securing ring 20.

Although the protruding stray part of the woven conductor may be cut off, the cutting operation is troublesome. That is, in order to inhibit the above problem (contact of the woven conductor with other wiring and electric component), it is necessary to cut the protruding part at the base of the woven conductor. Attentiveness is required of the operator. Therefore, the cutting operation takes time.

The present invention has been made in view of the above problems. An object of the present invention is to simplify the pressure-bonding operation in a coaxial cable connector that is designed to pressure-bond and fix a coaxial cable to a connector body with a securing ring, after the connector body is attached to the tip end of the coaxial cable.

Means to Solve the Problems

In one aspect, a coaxial cable connector has a connector body, a securing ring, and a fixation section. The connector body includes: a tubular insertion section that is insertable between an insulation member around a core wire of a coaxial cable and a woven conductor around the insulation member; a flange section that is provided around the insertion section and with which both the woven conductor of the coaxial cable and a cover member around the woven conductor come into contact to position the insertion section with respect to the coaxial cable when the insertion section is inserted in the coaxial cable; and an annular fitting section that is provided at the insertion section, on an opposite side of the coaxial cable, and into which an object to be connected is insertable. The securing ring is used to pressure-bond and fix the coaxial cable to the insertion section from a periphery of the coaxial cable after the insertion section of the connector body is inserted in the coaxial cable. The fixation section is used to fix the connector body and the securing ring together.

In another aspect, the fixation section for fixing the securing ring is provided at the flange section of the connector body.

In another aspect, the fixation section is provided in a protruding manner at the flange section, on a surface on an opposite side of the fitting section, and has a plurality of projections adapted to fit to an inner peripheral surface or an outer peripheral surface of the securing ring.

In another aspect, the fixation section is provided in a protruding manner at the flange section, on a surface on an opposite side of the fitting section, and has an annular projection adapted to fit to an inner peripheral surface or an outer peripheral surface of the securing ring.

In another aspect, a pair of pressure-bonding projections to come into contact with a tool upon pressure-bonding are provided on the outer peripheral surface of the securing ring, and notches through which the pair of pressure-bonding projections can project outward of a ring are formed at the fixation section.

In another aspect, a length of projection from the flange section of the fixation section is longer than a length in a direction of a central axis of the securing ring, and an open end of the fixation section is inwardly bent after the securing ring is received inside the ring of the fixation section, so that the securing ring is positioned and fixed inside the ring of the fixation section.

In another aspect, a positioning projection for positioning the securing ring on a side closer to the coaxial cable than a contact surface with which the woven conductor or the cover member of the coaxial cable comes into contact is formed along an inner periphery of the fixation section, at the flange section on a surface on a side where the fixation section is provided in a protruding manner.

In another aspect, a rotation inhibiting projection which engages with the woven conductor of the coaxial cable and inhibits the connector body from rotating around a center axis of the coaxial cable, when the insertion section is inserted between the insulation member and the woven conductor of the coaxial cable, is formed on an outer periphery of the insertion section.

In another aspect, the fitting section is attached to the insertion section on the opposite side of the coaxial cable in a manner rotatable around a center axis of the insertion section, and a screw thread into which the object to be connected can be screwed is formed on an inner peripheral surface of the fitting section.

In another aspect, the fitting section is provided with a spring member that presses and biases the object to be connected from its periphery.

In another aspect, the fixation section for fixing the securing ring is provided at the securing ring.

In another aspect, an annular skirt section is provided at the flange section, on a surface on an opposite side of the fitting section, in a manner to surround an end section of the woven conductor of the coaxial cable and the cover member around the woven conductor, and the fixation section has an annular projection or a plurality of projections adapted to fit to an inner peripheral surface of the skirt section.

In another aspect, the fixation section is formed such that one end side in a direction of a center axis of the securing ring is larger in diameter than a pressure-bonding section which is pressure-bonded around the coaxial cable, so that the flange section can be inserted and fixed to the fixation section, and a notch section for separating the fixation section and the pressure-bonding section is formed at the securing ring.

Effect of the Invention

In the coaxial cable connector disclosed herein, the connector body includes not only the tubular insertion section, the flange section provided around the insertion section, and the fitting section provided at the insertion section on the opposite side of the coaxial cable, but also includes the fixation section for fixing the connector body and the securing ring together.

Accordingly, when attaching the coaxial cable connector of the present invention to the tip end of the coaxial cable, the connector body is inserted from the tip end side of the coaxial cable such that the insulation member of the coaxial cable is passed into the insertion section of the connector body, in a state that the securing ring is fixed to the connector body, after the tip end of the coaxial cable is processed as before. In this manner, the woven conductor that has been folded back rearward from the tip end side of the coaxial cable is automatically received into the securing ring.

Thus, according to the coaxial cable connector of the present invention, it is not necessary to move the securing ring to receive the woven conductor inside the securing ring as before, when pressure-bonding and fixing the coaxial cable to the insertion section of the connector body with the securing ring. After attaching the connector body to the tip end of the coaxial cable, the securing ring fixed to the connector body can be simply pressure-bonded with a pair of pliers or the like. The coaxial cable connector can be smartly fixed to the tip end of the coaxial cable in this manner. Thus, according to the present invention, the pressure-bonding operation can be extremely easily carried out.

The fixation section may be provided at the flange section of the connector body, or may be provided at the securing ring. Moreover, the fixation section may be provided at both or separately from both the flange section and the securing ring. In either case, the pressure-bonding operation can be extremely easily carried out.

Here, the fixation section can be composed of a plurality of projections provided in a protruding manner at the flange section, on the surface on the opposite side of the fitting section, or can be composed of an annular projection formed at the flange section, on the surface on the opposite side of the fitting section.

Specifically, in case that the annular projection is formed at the flange section and the outer peripheral surface of the securing ring is fitted to the inner periphery of the projection, and if a pair of pressure-bonding projections with which a pressure-bonding tool comes into contact are provided in a protruding manner on the outer peripheral surface of the securing ring in the same manner as before as shown in FIGS. 15(*a*)-(*e*), it is preferable that part of the ring which composes the fixation section is notched.

That is, if the fixation section is so composed, the pair of pressure-bonding projections provided in a protruding manner at the securing ring can be projected outward of the ring of the fixation section, when the securing ring is fixed to the fixation section. The securing ring can be easily pressure-bonded with a pair of pliers or the like.

In the coaxial cable connector, the length of projection from the flange section of the fixation section may be set longer than the length in a direction of the center axis of the securing ring, the securing ring may be received inside the ring of the fixation section, and an open end of the fixation section may be inwardly bent.

In this manner, the securing ring is positioned and fixed inside the ring of the fixation section. The securing ring no longer moves in an axial direction at the time of the pressure-bonding operation of the securing ring. Operability upon pressure-bonding the securing ring can be improved.

Also in this case, the securing ring is integrated with the connector body via the fixation section. Thus, even if a fixed portion of the cover member of the coaxial cable is hardened and becomes thin by aging after the connector is attached to the tip end of a coaxial cable, the fixed portion will not fall off from the connector body together with the securing ring. Electric connection can be maintained between the connector and the coaxial cable.

In case that the securing ring is fixed inside the fixation section of the flange section as above, the securing ring may stand in the way and may not allow to confirm whether the insertion section is reliably inserted between the insulation member and the woven conductor of the coaxial cable when attaching the connector body to the tip end of the coaxial cable.

Thus, a positioning projection for positioning the securing ring on a side closer to the coaxial cable than a contact surface with which the woven conductor or the cover member of the coaxial cable comes into contact may be formed along the inner periphery of the fixation section, at the flange section on a surface on a side where the fixation section is provided in a protruding manner.

That is, if the positioning projection is formed at the flange section in this manner, the securing ring is disposed on the side closer to the coaxial cable than the contact surface with which the woven conductor or the cover member of the coaxial cable comes into contact, when attaching the connector body to the coaxial cable. As a result, a gap is produced between the contact surface and the end section of the securing ring on the side of the flange section.

The positioning projection is formed along the inner periphery of the fixation section, and not formed at notched portions of the fixation section from which the pressure-bonding projections of the securing ring are projected. Thus, when attaching the connector body to the tip end of the coaxial cable, the gap between the contact surface of the flange section and the securing ring can be viewed from the notched portions.

Thus, it is easy to visually confirm, when attaching the connector body to the tip end of the coaxial cable, whether or not the woven conductor and the cover member of the coaxial cable come into contact with the contact surface of the flange section, that is, whether or not the connector body firmly receives the coaxial cable. Attachment of the connector body to the coaxial cable can be easily and reliably carried out.

Even if the connector body is attached to the tip end of the coaxial cable and the cover member of the coaxial cable is fixed around the insertion section by the securing ring, the connector body may rotate around the center axis of the coaxial cable and fall off from the connector body by the rotation, if tightening by the securing ring is loose or the fixed portion of the cover member becomes thin by aging.

In order to avoid such a problem, a rotation inhibiting projection may be formed on an outer periphery of the insertion section. That is, if the rotation inhibiting projection is formed on the outer periphery of the insertion section, this rotation inhibiting projection can inhibit the connector body from rotating around the center axis of the coaxial cable and falling off from the connector body, in case that tightening by the securing ring is loose or the fixed portion of the cover member becomes thin by aging.

It is preferable that the rotation inhibiting projection is formed so as not to stand in the way when the insertion section is inserted between the insulating member and the woven conductor of the coaxial cable. For this purpose, the rotation inhibiting projection may be linearly formed along the center axis of the insertion section, as a so-called projected bar.

A screw thread into which an object to be connected can be screwed may be formed on the inner peripheral surface of the fitting section, and the fitting section may be attached to the insertion section on the opposite side of the coaxial cable in a manner rotatable around the center axis of the insertion section. Alternatively, a spring member which presses and biases an object to be connected from the periphery may be provided at the fitting section.

An object to be connected can be screwed into the fitting section as a so-called nut, as in the conventional connector shown in FIGS. 15(*a*)-(*e*), so that the object to be connected is firmly fixed inside the fitting section.

When the fitting section is provided with a spring member, the object to be connected is gripped by a biasing force of the spring member. Thus, the object to be connected is easy to come off as compared to the case when the fitting section has a screw thread formed on an inner peripheral surface thereof. However, connection of the object to be connected with the coaxial cable connector only requires inserting the object to be connected into the fitting section. Thus, the connecting operation is simplified. Also in this case, it is not necessary to provide the fitting section in a manner rotatable with respect to the insertion portion. The fitting section can be integrally formed with the insertion section and the flange section. Thus, manufacturing of the connector body is simplified.

If the techniques set forth in Paragraphs 41-43 above are provided together, connection between the fitting section and the object to be connected can be achieved by either or both of the screwing by a screw and the biasing force by the spring member. Usability of the coaxial cable connector can be improved.

As noted above, the fixation section for fixing the securing ring to the flange section of the connector body is provided at the securing ring. Therefore, there is an effect that the pressure-bonding operation can be extremely easily carried out.

Here, for example, in order to fit the flange section of the connector body, the fixation section may be provided with a plurality of projections for fitting the flange section at one open end of the securing ring. However, for example, if the annular skirt section is provided to surround the woven conductor of the coaxial cable and the cover member around the woven conductor, at the flange section on the surface on the opposite side of the fitting section, the fixation section may be composed of an annular projection or a plurality of projections adapted to fit to the inner peripheral surface of the skirt section.

The fixation section may also be formed such that one end side in a direction of the center axis of the securing ring is larger in diameter than a pressure-bonding section which is pressure-bonded around the coaxial cable, so that the flange section can be inserted and fixed to the fixation section.

In case that the securing ring is composed as above, however, it is preferable to form a notch section at the securing ring, for separating the fixation section and the pressure-bonding section, so that the portion having a smaller diameter than the fixation portion of the securing ring (that is, the pressure-bonding section) can be pressure-bonded with a pair of pliers or the like, in a state that the securing ring is fixed to the flange section of the connector body.

EXPLANATION OF REFERENCE NUMERALS

2 . . . coaxial cable, 4 . . . core wire, 6 . . . insulation member, 8 . . . woven conductor, 9 . . . cover member, 10 . . . connector body, 11 . . . projected bar, 12 . . . insertion section, 13 . . . swaged section, 14 . . . flange section, 15 . . . annular projection, 16 . . . fitting section, 16*a* . . . screw thread, 16*b* . . . leaf spring, 16*c* . . . hexagonal nut, 16*d* . . . knurling section, 16*e* . . . slit, 16*f* . . . ring spring, 17 . . . projection, 18 . . . skirt section, 19 . . . step, 20 . . . securing ring, 22, 24 . . . pressure-bonding projection, 26 . . . annular projection, 27 . . . projection.

BEST MODE FOR CARRYING OUT THE INVENTION

Embodiments of the present invention will be explained hereinafter.

First Embodiment

Figure 1:
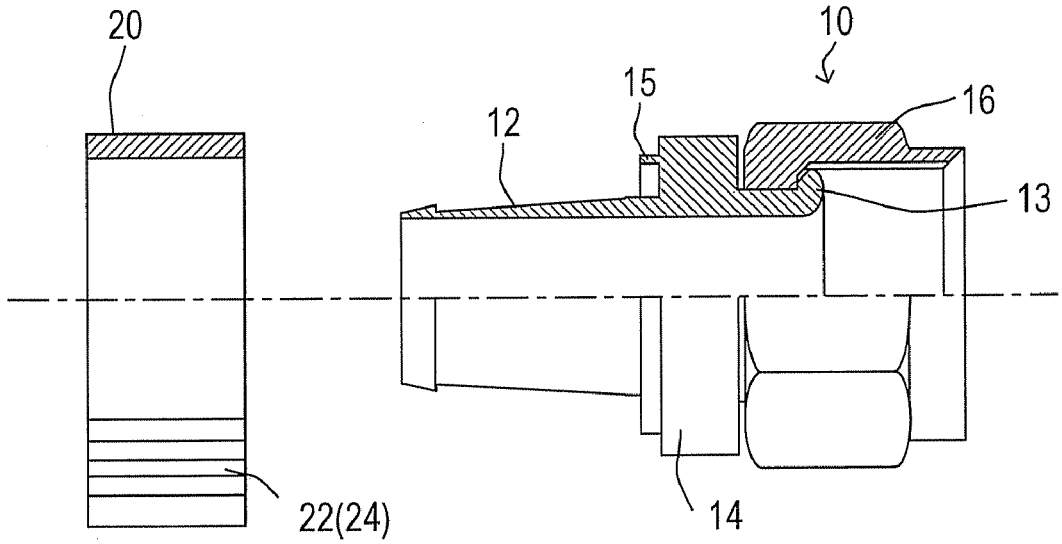
FIG. 1 is a partially fractured side view showing a composition of a coaxial cable connector according to a first embodiment.
Figure 2A:
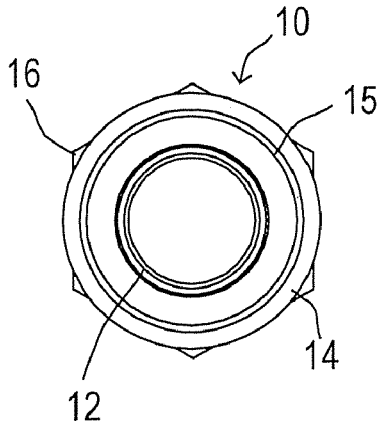
FIGS. 2(*a*)-(*b*) are explanatory views showing appearances of a connector body shown in FIG. 1.
Figure 2B:
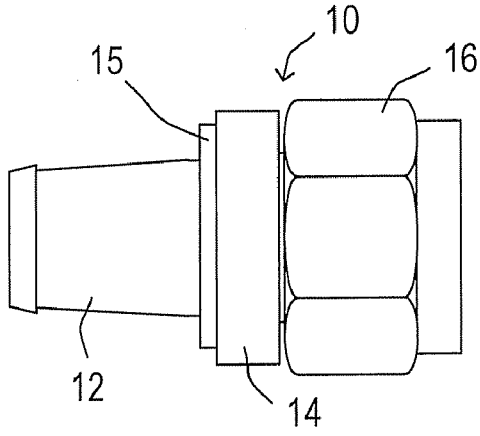

FIG. 1 is a partially fractured side view showing a composition of a coaxial cable connector (hereinafter, simply referred to as a connector) of an embodiment according to the present invention. FIGS. 2(*a*) and (*b*) are explanatory views showing appearances of a connector body composing the connector. In FIG. 1, an upper part of a dashed line along a center axis of the connector shows a cross section of the connector, and a lower part of the dashed line shows an appearance of the connector. FIG. 2(*a*) is an end view of the connector body viewed from a side to be attached to a coaxial cable. FIG. 2(*b*) is a side view of the connector body.

The connector of the present embodiment is used to connect a coaxial cable with an object to be connected such as an F-type relay, an F-type antenna terminal and so on. As shown in FIG. 1, the connector of the present embodiment includes a connector body 10 and a securing ring 20, as in the conventional connector shown in FIGS. 15(*a*)-(*e*).

Also, as shown in FIGS. 1, 2(*a*) and (*b*), the connector body 10 includes: a tubular insertion section 12 that is insertable between an insulation member around a core wire of a coaxial cable 2 and a woven conductor; a flange section 14 that is provided around the insertion section 12 to position the coaxial cable; and a fitting section 16 in the form of a hexagonal nut that is rotatably provided at the insertion section 12 on the opposite side of the coaxial cable, and into which an external conductor of an object to be connected can be screwed, as in the conventional connector shown in FIGS. 15(*a*)-(*e*).

In the present embodiment, as is clear from FIG. 1, the insertion section 12 and the flange section 14 are integrally formed. The connector body 10 is assembled by the steps of inserting the insertion section 12 on a side opposite to a side to be inserted in the coaxial cable, into a hole at a rear end of the fitting section 16, and outwardly swaging an open edge of the insertion section 12, so that a rear end section of the fitting section 16 is rotatably fixed between a swaged section 13 and the flange section 14.

The securing ring 20 has an annular ring and a pair of pressure-bonding projections 22, 24 provided thereon in a protruding manner, as in the conventional connector shown in FIGS. 15(*a*)-(*e*). The inner diameter of the securing ring 20 is smaller than the outer diameter of the flange section 14 of the connector body 10.

In the present embodiment, as is clear from FIGS. 2(*a*) and (*b*), a ring-like projection (annular projection) 15 adapted to fit to the inner peripheral surface of the securing ring 20 is provided at the flange section 14 of the connector body 10, on a surface on the opposite side of the fitting section 16.

Figure 3A:
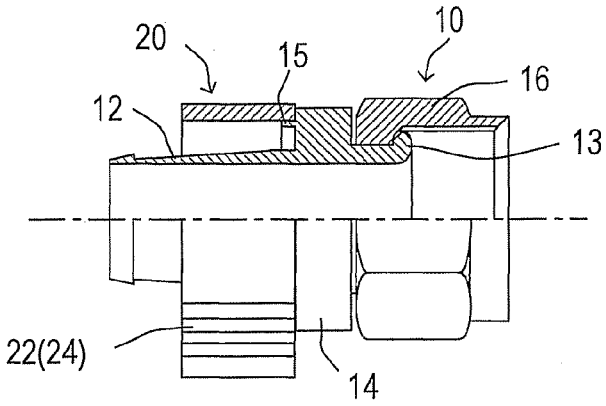
FIGS. 3(*a*)-(*c*) are explanatory views illustrating attachment steps of the coaxial cable connector shown in FIGS. 1 and 2A-2B to a coaxial cable.
Figure 3B:
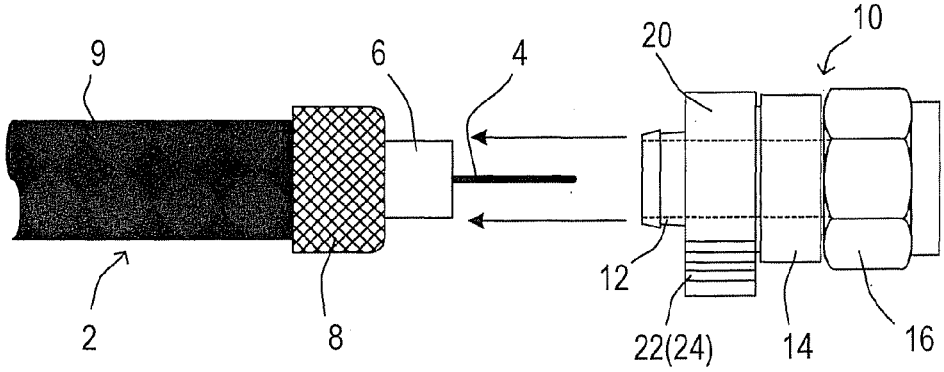
Figure 3C:
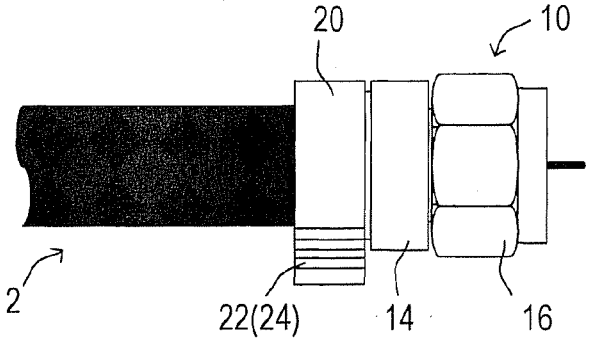

When attaching the connector of the present embodiment constituted as such to a tip end of the coaxial cable, the securing ring 20 is first fitted to the annular projection 15 provided in a protruding manner at the flange section 14 of the connector body 10 so that the securing ring 20 is fixed to the connector body 10, as shown in FIG. 3(*a*).

The tip end of the coaxial cable 2, as shown in FIG. 3(*b*), is processed in the same manner as before as shown in FIGS. 15(*a*)-(*e*), so that the insertion section 12 of the connector body 10 is easy to be inserted between the insulation member 6 and the woven conductor 8. Thereafter, while the securing ring 20 is fixed to the flange section 14, the connector body 10 is inserted from the tip end side of the cable such that the insulation member 6 of the coaxial cable 2 is passed into the insertion section 12 of the connector body 10.

As a result, as shown in FIG. 3(*c*), the woven conductor 8, which is folded back rearward from the tip end side of the coaxial cable 2, is automatically received inside the securing ring 20. Thereafter, when the pressure-bonding projections 22, 24 of the securing ring 20 are pressure-bonded with a pair of pliers or the like as before, the connector can be smartly fixed to the tip end of the coaxial cable 2.

Thus, according to the connector of the present embodiment, the pressure-bonding operation, and the attaching operation to the coaxial cable 2, can be extremely easily carried out as compared to before.

The annular projection 15 is formed thin-walled, for example, with a thickness of about 0.1 mm, so as not to disturb the pressure-bonding operation of the securing ring 20. The length of projection is also set to a minimum length (of about 1 mm, for example) required to fix the securing ring 20. That is, in this manner, when the securing ring 20 is pressure-bonded, the annular projection 15 is deformed so as not to disturb the pressure-bonding operation.

In the above, an embodiment of the present invention has been described. However, the present invention should not be limited to the above embodiment, but can be practiced in various manners within the scope not departing from the gist of the present invention.

(Variation 1: See FIGS. 4(*a*) and (*b*))

Figure 4A:
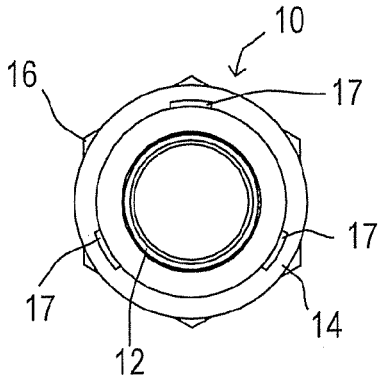
FIGS. 4(*a*)-(*b*) are explanatory views showing appearances of a connector body of a coaxial cable connector according to variation 1.
Figure 4B:
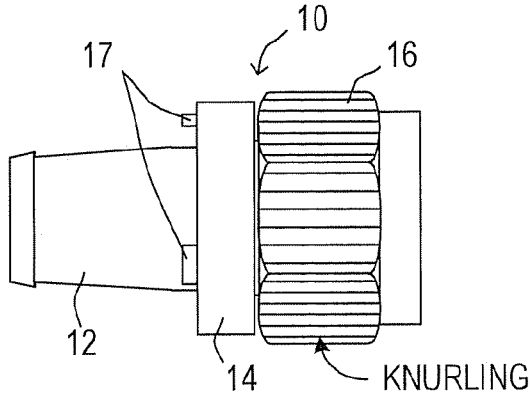

For instance, in the above embodiment, the annular projection 15 adapted to fit to the inner peripheral surface of the securing ring 20 is provided in a protruding manner at the flange section 14 of the connector body 10. However, for example, as shown in FIGS. 4(*a*) and (*b*), a plurality of projections 17 (three, in the figures) may be arranged at the flange section 14 of the connector body 10, to be adapted to fit into the inner peripheral surface of the securing ring 20. In this manner as well, the same effect as in the above embodiment can be achieved. In case that the plurality of projections 17 are provided in a protruding manner at the flange section 14 as such, the size and the number of the projections 17 may be determined as required so that the securing ring 20 can be fixed, depending on the size and the weight of the securing ring 20.

Also, as shown in FIGS. 4(*a*) and (*b*), if a knurling is formed on the outer peripheral surface of the fitting section 16 of the connector body 10, slipping which occurs upon rotating the fitting section 16 can be inhibited. The users can easily attach or detach the fitting section 16 to or from an object to be connected with their fingertips or by means of tools such as a wrench or the like. The fitting section 16 shown in FIGS. 4(*a*) and (*b*) shows a knurling formed along the center axis of the fitting section 16. However, this is only to facilitate molding of the fitting section 16 with a die. The knurling may be formed into a cross bar if formed at post processing.

FIGS. 4(*a*) and (*b*) are explanatory views showing a composition of the connector body 10, at the flange section 14 of which a plurality of projections 17 are provided as the fixation section in a protruding manner. FIG. 4(*a*) is an end view of the connector body 10 viewed from the side attached to the coaxial cable. FIG. 4(*b*) is a side view of the connector body 10.

(Variation 2: See FIGS. 5(*a*), (*b*) and (*c*))

Figure 5A:
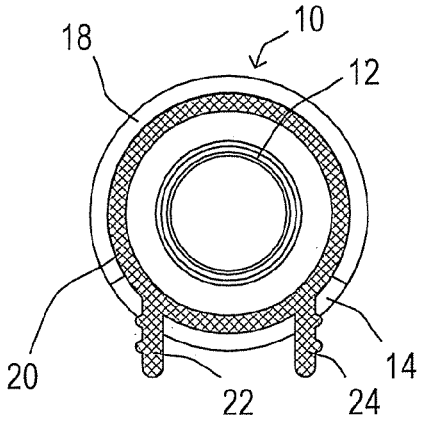
FIGS. 5(*a*)-(*c*) are explanatory views showing a composition of a coaxial cable connector according to variation 2 and an attachment condition of a coaxial cable.
Figure 5B:
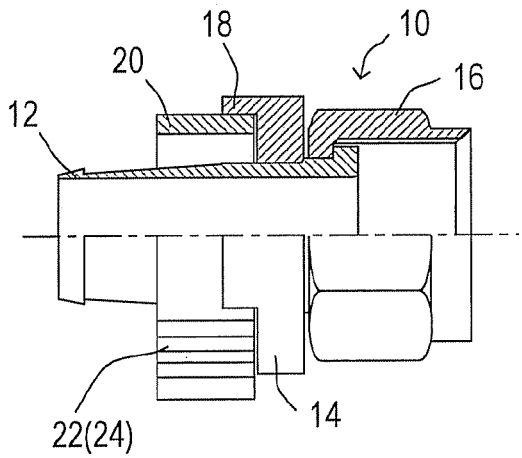
Figure 5C:
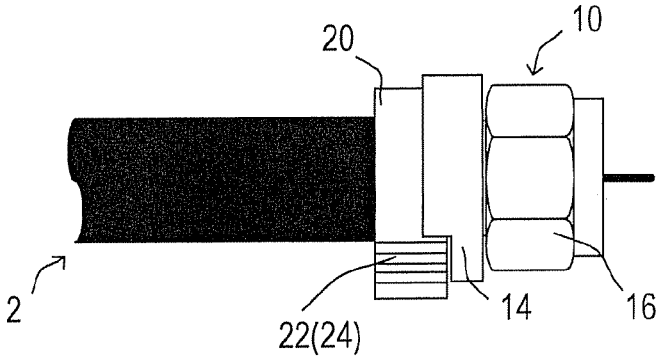

For example, as shown in FIGS. 5(*a*)-(*c*), if an annular skirt section 18 is provided at the connector body 10 in a manner to surround the end section of the coaxial cable 2 toward the opposite side of the fitting section 16 from the outer peripheral edge of the flange section 14, the inner diameter of the skirt section 18 (or the outer diameter of the securing ring 20) may be set such that the securing ring 20 can directly fit to the inner periphery of the skirt section 18.

In this case, however, as shown in FIGS. 5(*a*)-(*c*), when the pressure-bonding projections 22, 24 are provided in a protruding manner at the securing ring 20, part of the skirt section 18 which is an annular projection provided in a protruding manner at the flange section 14 has to be notched, so that, when the securing ring 20 is fitted to the skirt section 18, the pressure-bonding projections 22, 24 provided in a protruding manner at the securing ring 20 can project outward of the ring of the skirt section 18 and the pressure-bonding projections 22, 24 can be pressure-bonded with a pair of pliers or the like.

Also, when notching the part of the skirt section 18 provided in a protruding manner at the flange section 14 as above, it is preferable that the coaxial cable connector is composed by the flange section 14 and the insertion section 12 separately manufactured, and assembled by pressing the insertion section 12 into the skirt section 18 with the fitting section 16 interposed therebetween, as is clear from FIG. 5(*b*).

That is, the part of the insertion section 12 to be inserted in the coaxial cable has to be formed thin-walled. Therefore, the insertion section 12 is generally manufactured by cutting. Accordingly, if the flange section 14 and the insertion section 12 are integrally molded, the skirt section 18 and the notches have to be formed by cutting. However, forming notches at the skirt section by cutting is extremely bothersome, and substantially increases manufacturing costs as compared to the case before. If the coaxial cable connector of three-part type in which the flange section 14 and the insertion section 12 are separate bodies, the flange section 14 having the skirt section and the notches can be manufactured by molding. Therefore, no increase is caused in costs of the coaxial cable connector. Thus, when forming the skirt section 18 having notches at the flange section 14, it is preferable that the coaxial cable connector is of three-part type in which the flange section 14 and the insertion section 12 are separate bodies.

In the case of providing the plurality of projections 17 at the flange section 14 as shown in FIGS. 4(*a*) and (*b*), the coaxial cable connector of three-part type in which the flange section 14 and the insertion section 12 are separate bodies allows the plurality of projections 17 to be easily formed by molding of the flange section 14.

FIGS. 5(*a*)-(*c*) are explanatory views showing a composition of the coaxial cable connector adapted to attach the securing ring 20 to the connector body 10 having the skirt section 18 as the fixation section. FIG. 5(*a*) is an end view of the connector viewed from the side to be attached to the coaxial cable. FIG. 5(*b*) is a partially fractured side view of the connector. FIG. 5(*c*) is an end view showing a state in which the connector is fixed to the tip end of the coaxial cable 2.

(Variation 3: See FIGS. 6(*a*), (*b*) and (*c*))

Figure 6A:
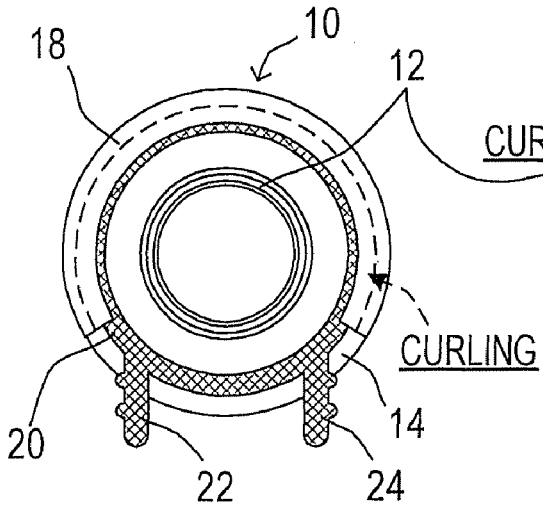
FIGS. 6(*a*)-(*c*) are explanatory views showing a composition of a coaxial cable connector according to variation 3 and an attachment condition of a coaxial cable.
Figure 6B:
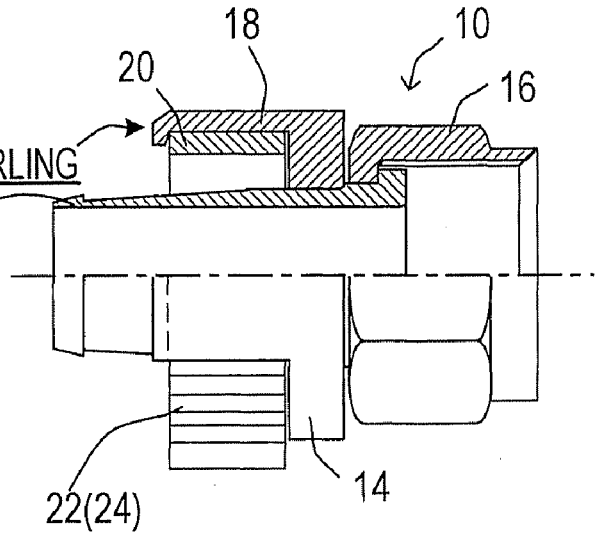
Figure 6C:
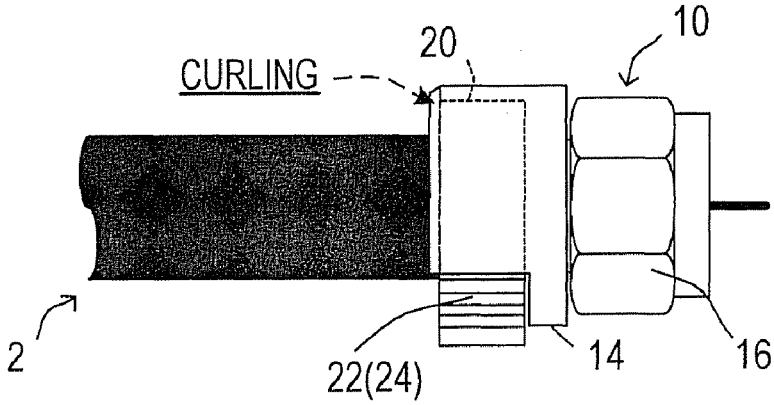

As in the above, in case that the annular skirt section 18 is provided at the flange section 14 of the connector body 10 as the fixation section of the present invention, the length of projection of the skirt section 18 from the flange section 14 may be set longer than a length in a direction of the center axis of the securing ring 20 so that the securing ring 20 is received inside the skirt section 18, as shown in FIGS. 6(*a*)-(*c*). Moreover, after the receipt of the securing ring 20, curling may be carried out which inwardly bends an open end of the skirt section 18 so that the securing ring 20 is positioned and fixed inside the skirt section 18.

In this case as well, however, it is necessary to form notches at the skirt section 18 through which the pressure-bonding projections 22, 24 of the securing ring 20 can project outward of the ring.

In this manner, since the securing ring 20 is integrated with the connector body 10, the securing ring 20 does not move in an axial direction upon the pressure-bonding operation of the securing ring 20. Operability upon pressure-bonding the securing ring 20 can be improved.

Also, even if a fixed portion of the covering member of the coaxial cable 2 is hardened and becomes thin by aging after the connector is attached to the tip end of the coaxial cable 2, integration of the securing ring 20 with the connector body 10 as such inhibits falling off of the fixed portion together with the securing ring 20 from the connector body 10. Electric connection between the connector and the coaxial cable 2 can be maintained.

FIGS. 6(*a*)-(*c*) are explanatory views showing a composition of the coaxial cable connector in receipt of the securing ring 20 inside the skirt section 18 of the connector body 10. FIG. 6(*a*) is an end view of the connector viewed from the side to be attached to the coaxial cable. FIG. 6(*b*) is a partially fractured side view of the connector. FIG. 6(*c*) is an end view showing a state in which the connector is fixed to the tip end of the coaxial cable 2.

(Variation 4: See FIGS. 7(*a*) and (*b*))

Figure 7A:
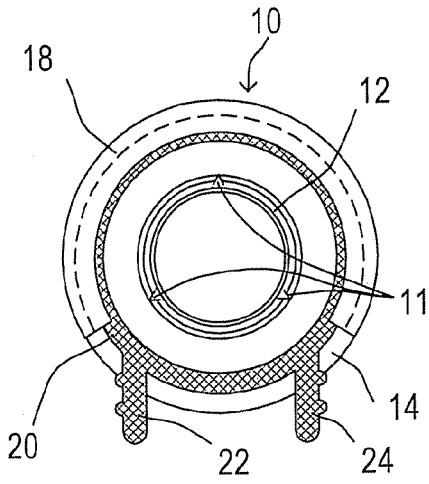
FIGS. 7(*a*)-(*b*) are explanatory views showing a composition of a coaxial cable connector according to variation 4.
Figure 7B:
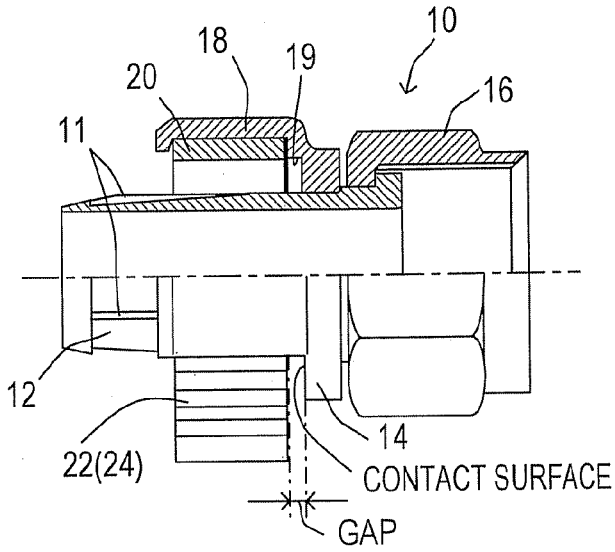
Figure 8A:
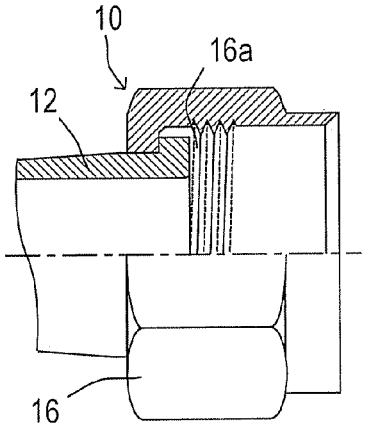
FIGS. 8(*a*)-(*d*) are explanatory views showing a composition of a fitting section of a coaxial cable connector according to variation 5.
Figure 8B:
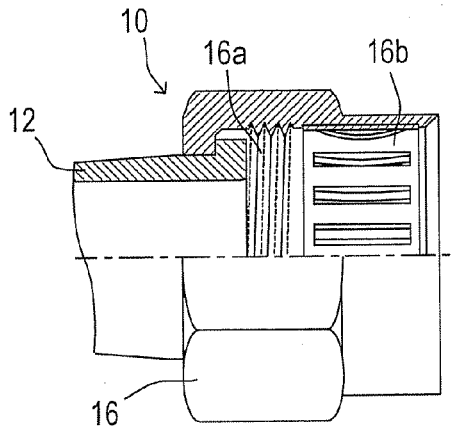
Figure 8C:
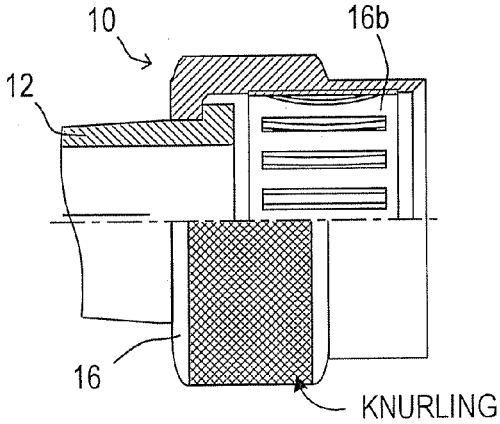
Figure 8D:
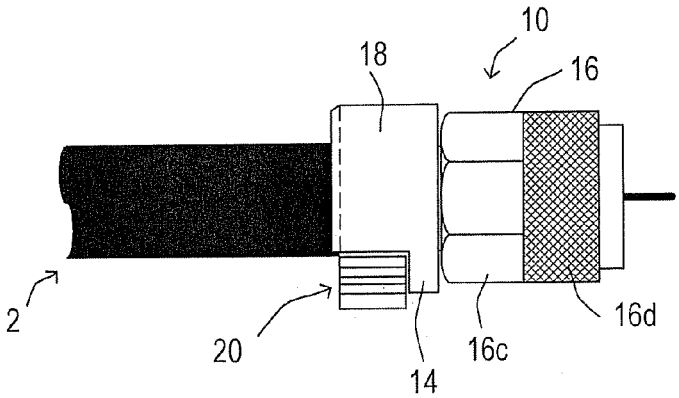

FIGS. 7(*a*) and (*b*) show further variations of the coaxial cable connector of the variation 3 shown in FIGS. 6(*a*)-(*c*). The variation shown in FIGS. 7(*a*) and (*b*) is different from the variation 3 shown in FIGS. 6(*a*)-(*c*) in that, a step 19 is provided along the inner periphery of the skirt section 18, on the surface on the side of the skirt section 18 of the flange section 14, and moreover, linear projected bars 11 are provided along the center axis of the insertion section 12, on the outer peripheral surface of the insertion section 12.

The step 19 is used to position the securing ring 20 on a side closer to the open end side of the skirt section 18 (in other words, on the side of the coaxial cable) than a contact surface with which the woven conductor and the cover member of the coaxial cable comes into contact at the flange section 14. The step 19 is formed by projecting the outer periphery of the contact surface of the flange section 14 along the inner periphery of the skirt section 18.

The projection of the flange section 14 from the contact surface corresponds to the positioning projection of the present invention. The length of projection is set to be about 1 mm, for example.

Accordingly, for example, a gap of about 1 mm is generated between the securing ring 20 and the contact surface of the flange section 14. When attaching the connector body 10 to the tip end of the coaxial cable, the users can easily and reliably confirm whether or not the connector body 10 is securely fitted to the coaxial cable by looking through the gap between the securing ring 20 and the contact surface of the flange section 14 from the notched portions of the skirt section 18.

The projected bars 11 are radially formed with respect to the center axis of the insertion section 12 at three points on the outer periphery of the insertion section 12. The length of projection from the outer peripheral surface of the insertion section 12 is set such that a distance from the center axis of the insertion section 12 to the tip end of each projected bar 11 is equal to a distance corresponding to a maximum diameter of the outer periphery of the insertion section 12.

The reason why the length of projection of the projected bars 11 is defined as such is to inhibit the projected bars 11 from getting in the way upon inserting the insertion section 12 into the hole of the flange section 14. The reason why the projected bars 11 are linearly formed along the center axis of the insertion section 12 is to inhibit the projected bars 11 from getting in the way upon inserting the insertion section 12 between the insulation member and the woven conductor of the coaxial cable.

If the projected bars 11 as rotation inhibiting projections are formed on the outer periphery of the insertion section 12 as such, the connector body 10 is inhibited from rotating on the center axis of the coaxial cable upon attaching the coaxial cable connector to the tip end of the coaxial cable, such as when tightening by the securing ring 20 is loose or the cover member becomes thin by aging. Falling off of the coaxial cable from the connector body 10 can be avoided.

In the example shown in FIGS. 7(*a*) and (*b*), the step 19 is formed on the contact surface of the flange section 14 along the inner periphery of the skirt section 18 to position the securing ring 20 at a position apart from the contact surface of the flange section 14. Instead of forming the step 19, a plurality of projections may be provided along the inner periphery of the skirt section 18. In this manner as well, the same effect can be achieved.

(Variation 5: See FIGS. 8(*a*), (*b*), (*c*) and (*d*))

In the above embodiment, the fitting section 16 is formed into a hexagonal nut into which an object to be connected such as an F-type relay, an F-type antenna terminal and so on can be screwed. However, it is not always necessary to form a screw thread in the entire region of the inner peripheral surface of the fitting section 16, like a so-called nut. For example, as shown in FIG. 8(*a*), a screw thread 16*a* may be formed only on the inner wall surface of the fitting section 16 on the side of the insertion section 12. The inner wall surface on the side of the open end of the fitting section 16 may be without the screw thread 16*a* and function as a guide which guides an object to be connected to the screw thread 16*a*. In this manner, the connector can be easily attached to the object to be connected.

In the case of composing the fitting section 16 as above, an annularly deformed leaf spring 16*b* may be provided on the inner wall surface on the side of the open end without the screw thread 16*a*, so that the object to be connected inserted into the fitting section 16 can be pressed and biased from the periphery to be firmly gripped, as shown in FIG. 8(*b*). In this manner, the object to be connected can be firmly fixed to the connector by screwing by the screw thread 16*a* and a biasing force by the leaf spring 16*b*. Moreover, the object to be connected can be temporarily attached to the connector by means of the leaf spring 16*b*.

Also, as shown in FIG. 8(*c*), the leaf spring 16*b* which is merely annularly deformed may be formed on the inner wall surface of the fitting section 16, without forming the screw thread 16*a*. In this manner, the fitting section 16 has to grip the object to be connected only by the biasing force of the leaf spring 16*b*. Thus, although the object to be connected is easy to come off as compared to the case of forming the screw thread 16*a*, it is only necessary to insert the object to be connected into the insertion section 16 upon connecting the object to be connected with the connector. Thus, the connecting operation becomes simple.

In the connector shown in FIG. 8(*c*), an object to be connected has only to be inserted into the fitting section 16. There is no need to rotate the fitting section 16 to screw the object to be connected. Thus, there is no need to form the periphery of the fitting section 16 into a hexagonal nut, but into a tubular shape. In this case, however, it is preferable to form a nonslip knurling on the periphery of the fitting section 16.

Instead of a knurling, a nonslip annular member formed from elastic synthetic resin, rubber or the like may cover the fitting section 16.

In the connector shown in FIG. 8(*c*), it is not necessary to provide the fitting section 16 in a manner rotatable about the insertion section 12. Thus, the fitting section 16 can be integrally formed with the insertion section 12 and the flange section 14.

As for the fitting section 16, the periphery of the fitting section 16 may be divided into an open end side and an insertion section 12 side, and one of the divided part (insertion section 12 side in the figure) may be formed as a hexagonal nut section 16*c* in the form of a hexagonal nut and the other part (open end side in the figure) may be formed as a knurling section 16*d* provided with a nonslip knurling, as shown in FIG. 8(*d*).

In this case, it is preferable that the knurling section 16*d* is round and concentric to the hexagonal nut section 16*c*, and the diameter is the same length as, or longer than, a diagonal line connecting apexes of the hexagonal nut section 16*c* (that is, the longest diagonal line in the hexagonal nut section 16*c*), in order to improve operability of the knurling section 16*d*.

(Variation 6: See FIGS. 9(*a*) and (*b*))

In the case of fixing an object to be connected inside the fitting section 16 by the biasing force of the spring, it is not always necessary to provide the leaf spring 16*b* annularly deformed inside the fitting section 16, as in the connector shown in FIG. 8(*c*). The fitting section 16 may be composed as shown in FIGS. 9(*a*) and (*b*).

Figure 9A:
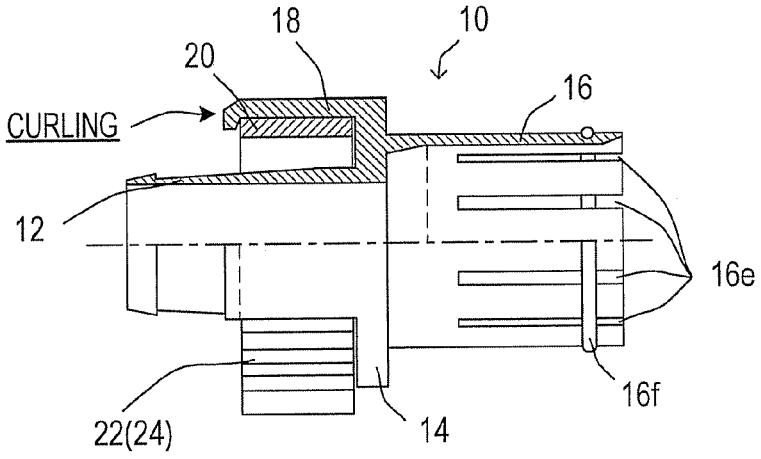
FIGS. 9(*a*)-(*b*) are explanatory views showing a composition of a fitting section of a coaxial cable connector according to variation 6.
Figure 9B:
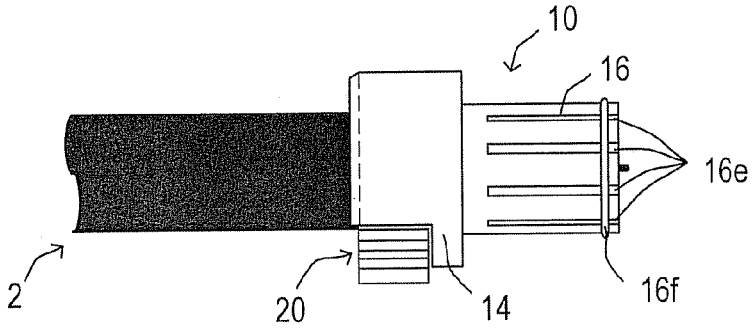

That is, the connector shown in FIGS. 9(*a*) and (*b*) is produced by integrally forming the insertion section 12, the flange section 14, the fitting section 16 and the skirt section 18 which compose the connector body 10, receiving the securing ring 20 inside the skirt section 18, and curling the open end of the skirt section 18. In this connector, a plurality of slits 16*e* are formed in a direction of the center axis from the open end side of the fitting section 16. Moreover, a ring spring 16*f* which inwardly biases the fitting section 16 is provided at an outer peripheral portion about the open end.

Accordingly, in the connector shown in FIGS. 9(*a*) and (*b*), when an object to be connected is inserted to the fitting section 16, the open end side of the fitting section 16 is radially deformed. However, the ring spring 16*f* inwardly biases the fitting section 16 in such a manner to inhibit the deformation. As a result, the object to be connected is firmly fixed inside the fitting section 16.

FIG. 9(*a*) is a partially fractured side view of the connector. FIG. 9(*b*) is a side view showing a state in which the connector is fixed to the tip end of the coaxial cable 2.

Second Embodiment

Figure 10:
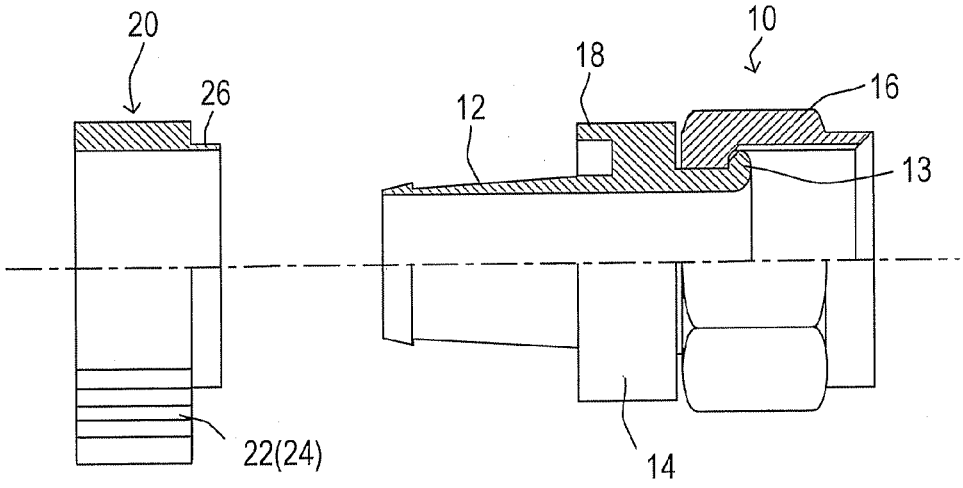
FIG. 10 is a partially fractured side view showing a composition of a coaxial cable connector according to a second embodiment.
Figure 11A:
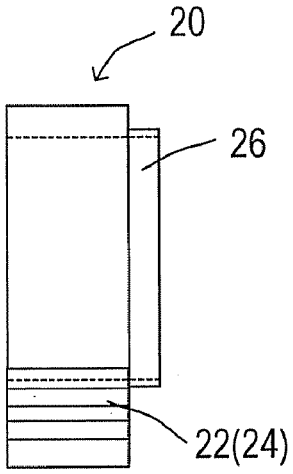
FIGS. 11(*a*)-(*b*) are explanatory views showing appearances of a securing ring according to the second embodiment.
Figure 11B:
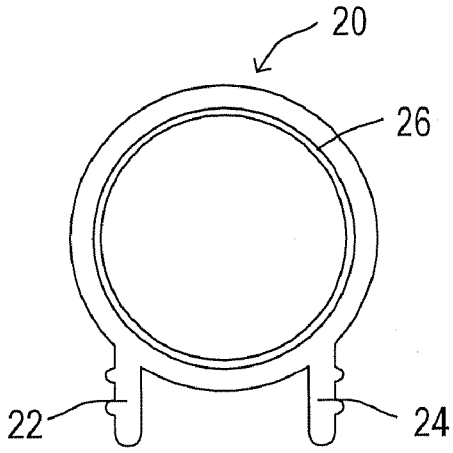

FIG. 10 is a partially fractured side view showing a composition of a coaxial cable connector (hereinafter, simply referred to as a connector) of a second embodiment according to the present invention. FIGS. 11(*a*) and (*b*) are explanatory views showing appearances of a securing ring composing the connector. In FIG. 10, an upper part of a dashed line along a center axis of the connector shows a cross section of the connector, and a lower part of the dashed line shows an appearance of the connector. FIG. 11(*a*) is a side view of the securing ring. FIG. 11(*b*) is an end view of the securing ring shown in FIG. 11(*a*) viewed from the right direction.

The connector of the present embodiment is used to connect a coaxial cable with an object to be connected such as an F-type connector and so on. As shown in FIG. 10, the connector of the present embodiment includes a connector body 10 and a securing ring 20, as in the conventional connector shown in FIGS. 15(*a*)-(*e*).

The connector body 10 includes: a tubular insertion section 12 that is insertable between an insulation member and a woven conductor around a core wire of a coaxial cable; a flange section 14 that is provided around the insertion section 12 to position the coaxial cable; and a fitting section 16 that is rotatably provided at the insertion section 12, on the opposite side of the coaxial cable, and into which an external conductor of an object to be connected can be screwed, as in the conventional connector shown in FIGS. 15(*a*)-(*e*).

The insertion section 12 and the flange section 14 are integrally formed. The connector body 10 is assembled by the steps of inserting the insertion section 12 from the side opposite to the side to be inserted in the coaxial cable into a hole at a rear end of the fitting section 16, and outwardly swaging the open edge of the insertion section 12 to rotatably fix the rear end of the fitting section 16 between a swaging section 13 and the flange section 14.

Also, on a surface of the flange section 14 on the side opposite to the fitting section 16, an annular skirt section 18 is provided in a protruding manner, as in the conventional connector, along the outer peripheral edge of the flange section 14 so that the skirt section 18 can surround the end section of the coaxial cable when the connector body 10 is attached to the tip end of the coaxial cable.

The securing ring 20 has an annular ring and a pair of pressure-bonding projections 22, 24 provided on the outer peripheral surface of the ring in a protruding manner, as in the conventional connector shown in FIGS. 15(*a*)-(*e*). In the present embodiment, a ring-like projection (annular projection) 26, which is thinner than the securing ring 20 (0.1 mm, for example), is further provided in a protruding manner at an end section of one of two openings of the securing ring 20. This annular projection 26 is formed along the inner peripheral surface of the securing ring 20 so that there is a step on the outer peripheral side from the side of the body of the securing ring 20.

The annular projection 26 is adapted to be fitted to the inner peripheral surface of the skirt section 18 of the connector body 10 and to fix the securing ring 20 to the connector body 10. In order to fit the annular projection 26 to the inner peripheral surface of the skirt section 18, the outer diameter of the annular projection 26 is set to be substantially the same as, and slightly smaller than, the inner diameter of the skirt section 18.

Figure 12A:
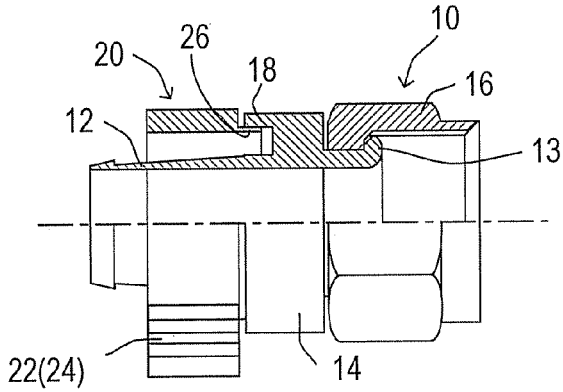
FIGS. 12(*a*)-(*c*) are explanatory views illustrating attachment steps of the coaxial cable connector according to the second embodiment to a coaxial cable.
Figure 12B:
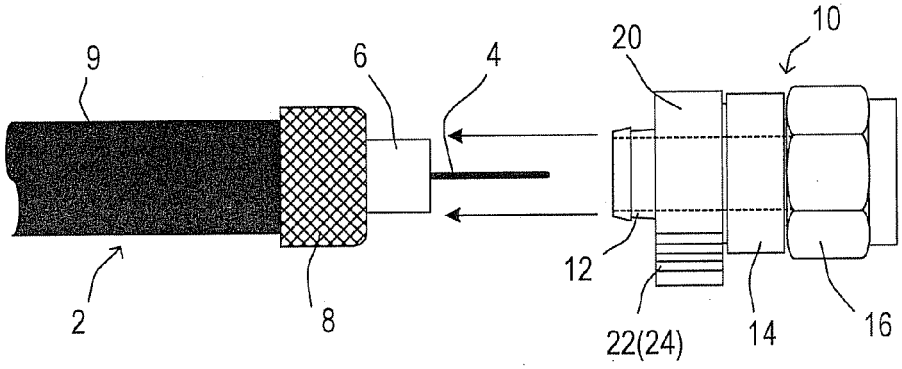
Figure 12C:
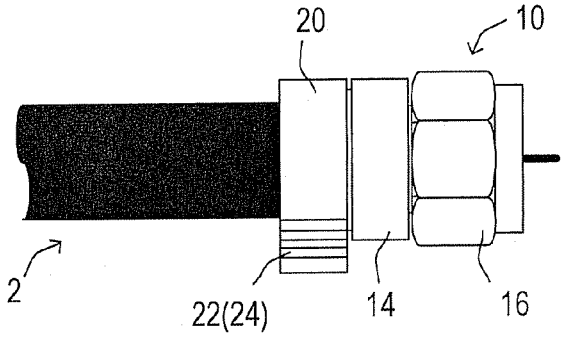

When attaching the connector of the present embodiment composed as such to a tip end of the coaxial cable, the annular projection 26 of the securing ring 20 is first fitted to the skirt section 18 of the connector body 10 to fix the securing ring 20 to the connector body 10, as shown in FIG. 12(*a*).

Also, the tip end of the coaxial cable 2, as shown in FIG. 12(*b*), is processed in the same manner as before as shown in FIGS. 15(*a*)-(*e*), so that the insertion section 12 of the connector body 10 can be easily inserted between the insulation member 6 and the woven conductor 8. Thereafter, while the securing ring 20 is fixed to the flange section 14, the connector body 10 is fitted from the tip end side of the cable such that the insulation member 6 of the coaxial cable 2 is passed into the insertion section 12 of the connector body 10.

As a result, as shown in FIG. 12(*c*), the woven conductor 8, which is folded back rearward from the tip end side of the coaxial cable 2, is automatically received inside the securing ring 20. Thereafter, when the pressure-bonding projections 22, 24 of the securing ring 20 are pressure-bonded with a pair of pliers or the like as before, the connector can be smartly fixed to the tip end of the coaxial cable 2.

Thus, according to the connector of the present embodiment, the pressure-bonding operation, and the attaching operation to the coaxial cable 2, can be extremely easily carried out, as compared to before.

In the above, an embodiment of the present invention has been described. However, the present invention should not be limited to the above described embodiments, but can be practiced in various manners within the scope not departing from the gist of the present invention.

Figure 13:
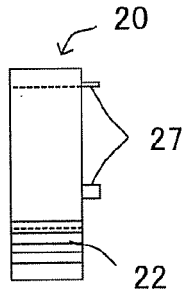
FIGS. 13(*a*1)-(*c*) are explanatory views showing other examples for composition of the securing ring and the connector body.
Figure 13:
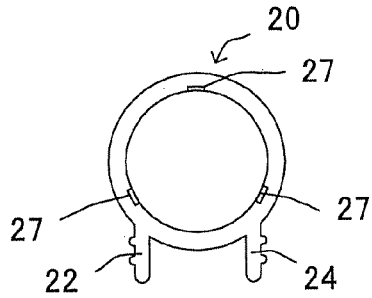
Figure 13:
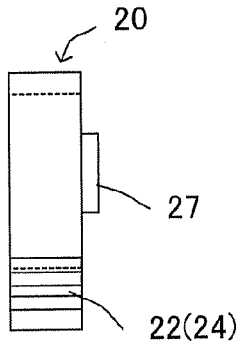
Figure 13:
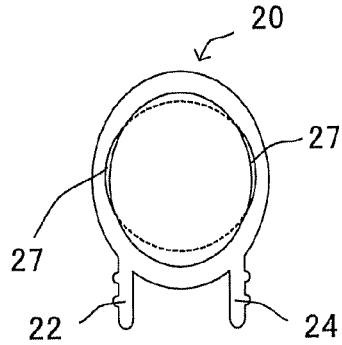
Figure 13C:
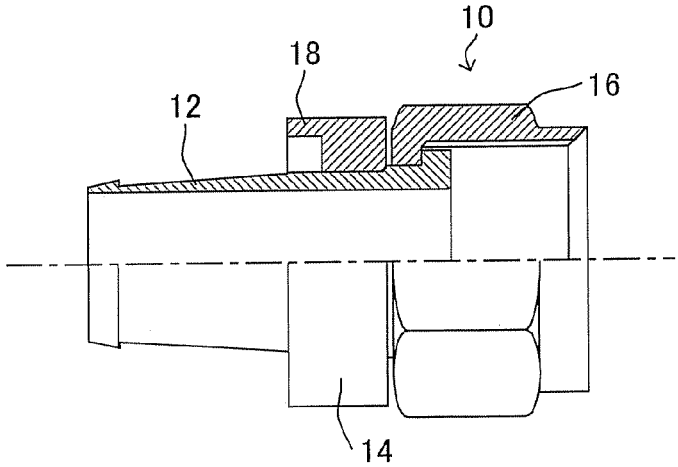

For instance, in the above embodiment, the annular projection 26 adapted to fit to the inner peripheral surface of the skirt section 18 of the connector body 10 is provided in a protruding manner at one open end section of the securing ring 20. However, for example, as shown in FIGS. 13(*a*-1) and (*b*-1), a plurality of projections 27 (three in the figure) may be arranged at one open end section of the securing ring 20 to be adapted to fit to the inner peripheral surface of the skirt section 18. The same effect as in the above embodiment can be obtained.

Also, in the case of providing a plurality of projections 27 in a protruding manner at the flange section 14 as above, the size and the number of the projections 27 may be arbitrarily set depending on the size and weight of the securing ring 20 so that the securing ring 20 can be fixed. For example, as shown in FIGS. 13(*a*-2) and (*b*-2), the securing ring 20 itself may be formed into an oval shape. If a pair of projections 27 are provided at both end sides of a small diameter portion of the oval in a protruding manner, the projections 27 can be easily formed by cutting.

That is, if the securing ring 20 is formed into an annular shape and the annular projection 26 is provided in a protruding manner on the surface of one open end as in the above embodiment, the annular projection 26 can be relatively easily formed by cutting. However, in order to form a plurality of projections 27 on the surface of one open end of the annular securing ring 20 by cutting, the cutting process becomes complicated, and thus increase is caused in costs of the securing ring 20. However, if the securing ring 20 is formed into an oval shape, a pair of projections 27 can be easily formed at both end sides of a small diameter portion of the oval, only by cutting one open end side of the securing ring 20 with a cutting tool disposed on a circle concentric to the securing ring 20. The securing ring 20 provided with the projections 27 to be fitted to the skirt section 18 can be implemented at low cost.

FIGS. 13(*a*-1) and (*b*-1) and FIGS. 13(*a*-2) and (*b*-2) are explanatory views showing an example of a composition of the securing ring 20 provided with the plurality of projections 27 as the fixation section. FIGS. 13(*a*-1) and (*a*-2) are the side views of the securing ring 20. FIGS. 13 (*b*-1) and (*b*-2) are the end views of the securing ring shown in FIGS. 13(*a*-1) and (*a*-2) viewed from the right direction.

In the above embodiment, the connector body 10 is composed by swaging and fixing the fitting section 16 to the integrally molded insertion section 12 and flange section 14. However, as shown in FIG. 13(*c*), the connector body 10 may be composed of separate bodies of the insertion section 12, the flange section 14 and the fitting section 16, and assembled by pressing the insertion section 12 into the skirt section 18 with the fitting section 16 interposed therebetween.

In the above embodiment, the securing ring 20 is provided with the annular projection 26 (or the projections 27) adapted to fit to the inner periphery of the skirt section 18 of the connector body 10. However, as shown in FIGS. 14(*a*) and (*b*), the diameter of the securing ring 20 on the side of one open end may be enlarged, so that the securing ring 20 can be directly fitted to the outer periphery of the flange section.

In this manner, even if the skirt section 18 is not formed at the flange section 14 of the connector body 10, the securing ring 20 can be fixed to the connector body 10.

In the case of composing a fixation section 30 to the connector body 10 by enlarging the diameter of the securing ring 20 on the side of one open end, however, it is necessary, in order that a portion having a smaller diameter (that is, a pressure-bonding section 28) than the fixation section 30 at the securing ring 20 can be easily pressure-bonded with a pair of pliers or the like in a state that the securing ring 20 is fixed to the flange section 14 of the connector body 10, to form a notched section 32 at the securing ring 20 to separate the fixation section 30 and the pressure-bonding section 28, as shown in FIG. 5.

Figure 14A:
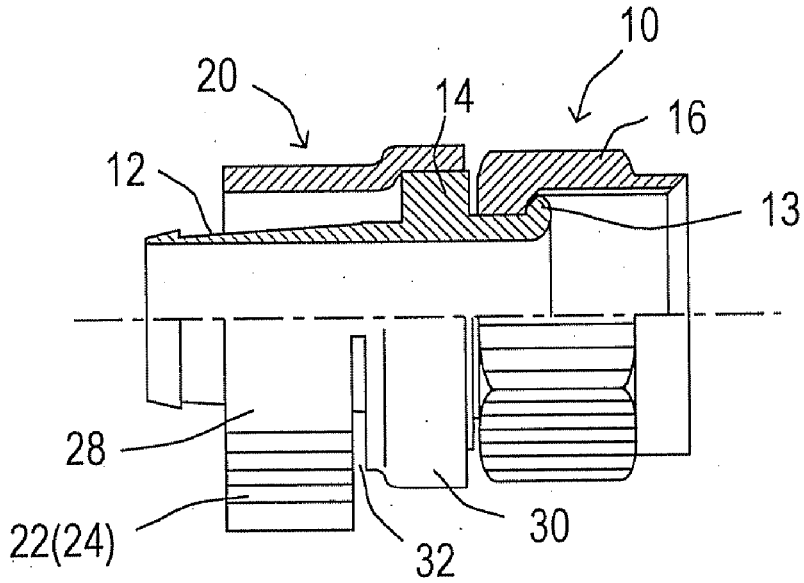
FIGS. 14(*a*)-(*b*) are explanatory views showing a composition of the coaxial cable connector designed such that the securing ring is attached to an outer periphery of a flange section of the connector body.
Figure 14B:
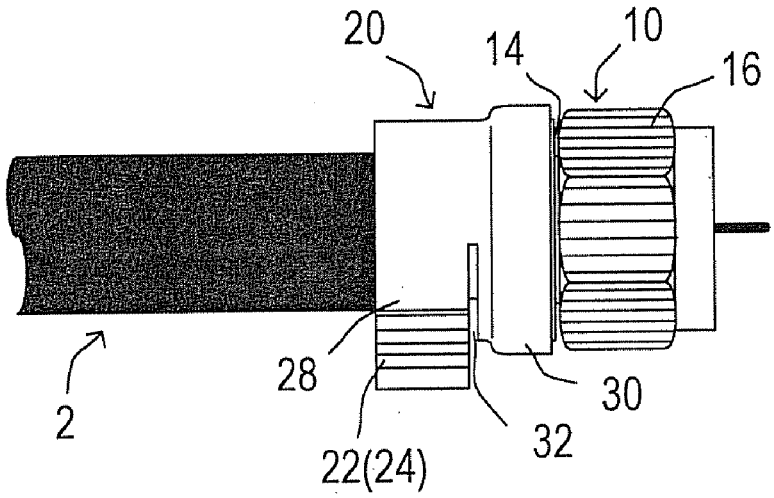
Figure 15A:
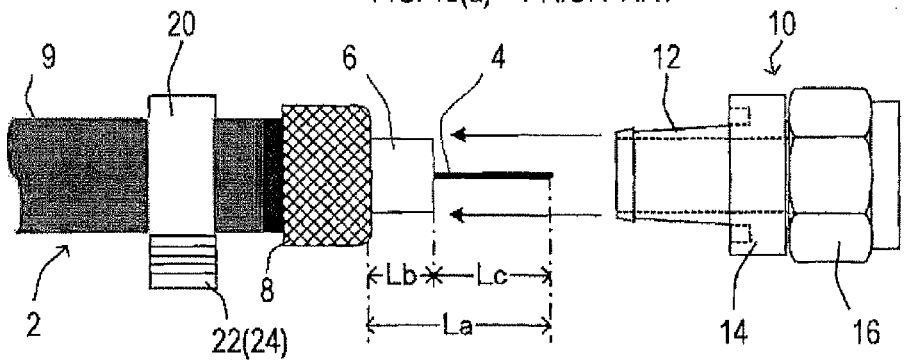
FIG. 15(a) PRIOR ART
FIGS. 15(*a*)-(*e*) are explanatory views illustrating a composition and attachment steps of a conventional coaxial cable connector to a coaxial cable.
Figure 15B:
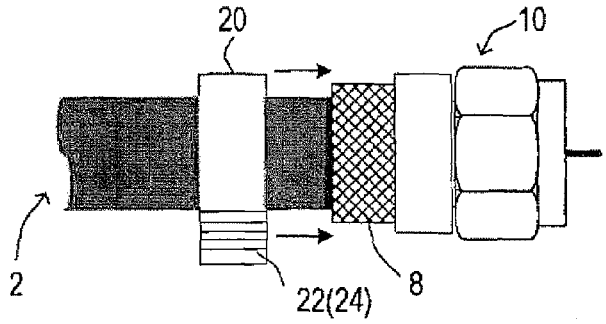
FIG. 15(b) PRIOR ART
Figure 15C:
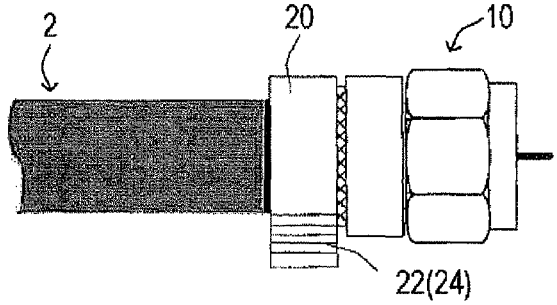
FIG. 15(c) PRIOR ART
Figure 15D:
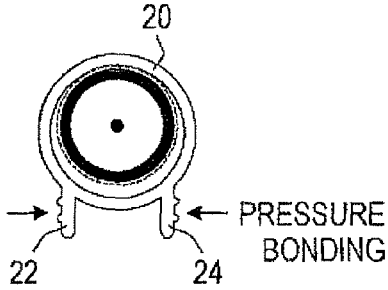
FIG. 15(d) PRIOR ART
Figure 15E:
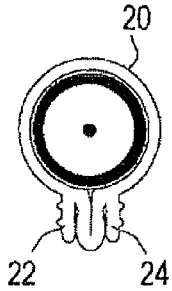
FIG. 15(e) PRIOR ART

Also, as shown in FIGS. 14(*a*) and (*b*), if a knurling is formed on the outer peripheral surface of the fitting section 16 of the connector body 10, slipping which occurs upon rotating the fitting section 16 can be inhibited. The users can easily attach or detach the fitting section 16 to or from an object to be connected with their fingertips or by means of tools such as a wrench or the like. The fitting section 16 shown in FIGS. 4(*a*) and (*b*) shows a knurling formed along the center axis of the fitting section 16. However, this is only to facilitate molding of the fitting section 16 with a die. The knurling may be formed into a cross bar if formed at post processing.

FIGS. 14(*a*) and (*b*) are explanatory views showing a composition of a coaxial cable connector designed such that the securing ring 20 is attached to the outer periphery of the flange section 14 of the connector body 10. FIG. 14(*a*) is a partially fractured side view of the connector. FIG. 14(*b*) is a side view showing a state in which the connector is fixed to the tip end of the coaxial cable 2.

In the above embodiment, the fixation section is provided at either the connector body or the securing ring. However, the fixation section may be provided at the both, or separately from the both as long as the connector body and the securing ring can be fixed together.

The invention claimed is:

1. A coaxial cable connector comprising a connector body including: a tubular insertion section that is insertable between an insulation member around a core wire of a coaxial cable and a woven conductor around the insulation member; a flange section that is provided around the insertion section and with which both the woven conductor of the coaxial cable and a cover member around the woven conductor come into contact to position the insertion section with respect to the coaxial cable when the insertion section is inserted in the coaxial cable; and an annular fitting section that is provided at the insertion section, on an opposite side of the coaxial cable, and into which an object to be connected is insertable, a securing ring that is used to pressure-bond and fix the coaxial cable to the insertion section from a periphery of the coaxial cable after the insertion section of the connector body is inserted in the coaxial cable, and a fixation section that is used to fix the connector body and the securing ring together, wherein the fixation section is configured to be a portion projecting from the flange section and have an annular shape for receiving the securing ring inside the fixation section when the fixation section is fitted to an outer peripheral surface of the securing ring, and wherein a length of projection of the fixation section is longer than a length in a direction of a central axis of the securing ring, wherein the fixation section for fixing the securing ring is provided at the flange section of the connector body, wherein a pair of pressure-bonding projections to come into contact with a tool upon pressure-bonding are provided on the outer peripheral surface of the securing ring, and notches through which the pair of pressure-bonding projections can project outward of a ring are formed at the fixation section, and wherein an open end of the fixation section is inwardly bent after the securing ring is received inside the ring of the fixation section, so that the securing ring is positioned and fixed inside the ring of the fixation section.

2. The coaxial cable connector according to claim 1, wherein a positioning projection for positioning the securing ring on a side closer to the coaxial cable than a contact surface with which the woven conductor or the cover member of the coaxial cable comes into contact is formed along an inner periphery of the fixation section, at the flange section on a surface on a side where the fixation section is provided in the protruding manner.

3. The coaxial cable connector according to claim 1 wherein a rotation inhibiting projection which engages with the woven conductor of the coaxial cable and inhibits the connector body from rotating around a center axis of the coaxial cable, when the insertion section is inserted between the insulation member and the woven conductor of the coaxial cable, is formed on an outer periphery of the insertion section.

4. The coaxial cable connector according to claim 1 wherein the fitting section is attached to the insertion section on the opposite side of the coaxial cable in a manner rotatable around a center axis of the insertion section, and a screw thread into which the object to be connected can be screwed is formed on an inner peripheral surface of the fitting section.

* * * * *